US007665195B1

(12) United States Patent
Vazquez-Perez

(10) Patent No.: US 7,665,195 B1
(45) Date of Patent: Feb. 23, 2010

(54) METHOD AND APPARATUS FOR ECOLOGICAL BURIAL

(76) Inventor: Jose Fernando Vazquez-Perez, #807 Ave. Fernandez Juncos 3er Nivel, Miramar, San Juan, PR (US) 00907

( * ) Notice: Subject to any disclaimer, the term of this patent is extended or adjusted under 35 U.S.C. 154(b) by 0 days.

(21) Appl. No.: 12/237,953

(22) Filed: Sep. 25, 2008

(51) Int. Cl.
*A61G 17/00* (2006.01)

(52) U.S. Cl. ..... 27/1

(58) Field of Classification Search ..... 27/1; D99/5, 17; 47/33, 74, 1.01 R, 58.1 R, 14, 47/17

See application file for complete search history.

(56) References Cited

U.S. PATENT DOCUMENTS 4,199,848 A 4/1980 Kohnert
4,977,652 A * 12/1990 Graham ..... 27/1
5,636,418 A * 6/1997 Vail et al. ..... 27/1
5,701,642 A * 12/1997 Order ..... 27/4
5,774,958 A 7/1998 Casimir
5,799,488 A * 9/1998 Truong ..... 47/1.01 R
5,815,897 A * 10/1998 Longstreth ..... 27/1
6,516,501 B2 * 2/2003 Vazquez-Perez ..... 27/1
7,373,702 B1 * 5/2008 Vonderheide ..... 27/1
2008/0141508 A1 * 6/2008 Silva ..... 27/1

* cited by examiner

*Primary Examiner*—William L. Miller

(57) ABSTRACT

The urn of the invention comprises a series of pod-like containers designed to function as cinerary urns (i.e. receptacles for human ashes) comprising a bottom shell and a top cover made of biodegradable materials. The bottom shell having a hollow protrusion for a direct contact with the earth, while the top cover has several holes promoting the germination of the living monument. The urn is meant to be used with new or pre-existing plants producing a living monument in memory of the deceased person whose ashes it contains.

14 Claims, 5 Drawing Sheets

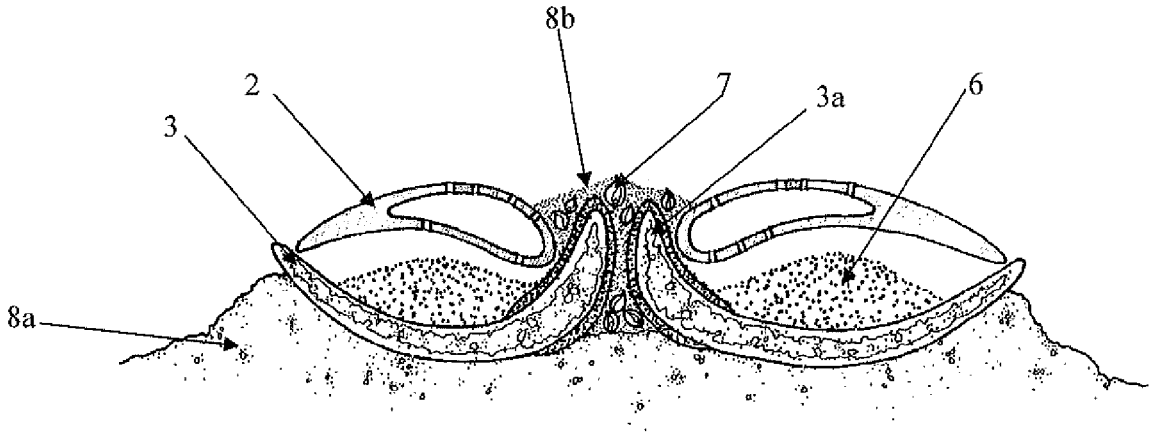
Fig. 3
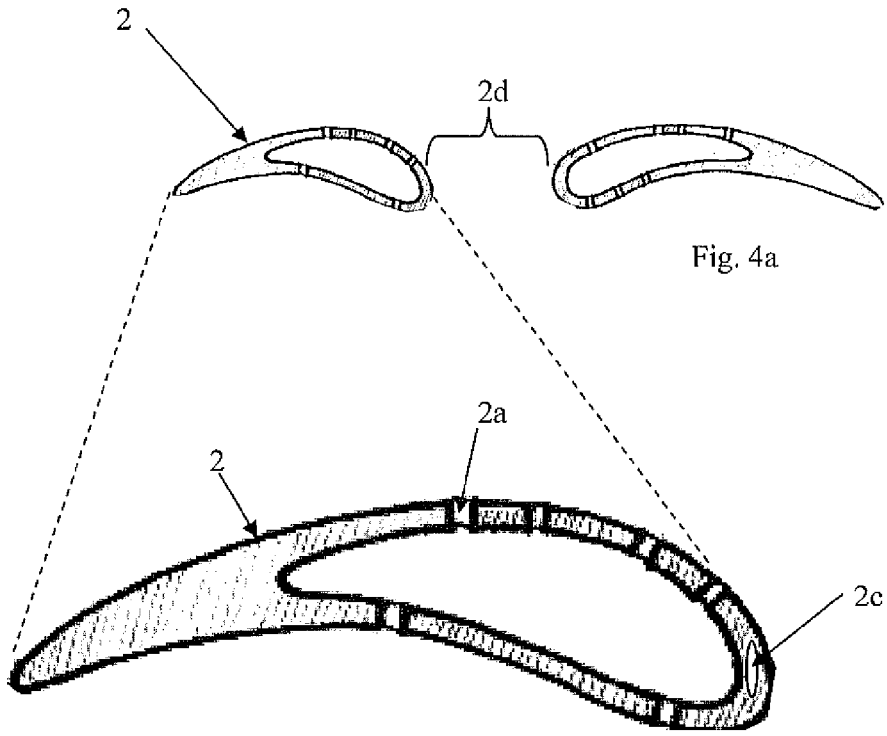
Fig. 4a
Fig. 4b

METHOD AND APPARATUS FOR ECOLOGICAL BURIAL

STATEMENT REGARDING FEDERALLY SPONSORED RESEARCH AND DEVELOPMENT

N/A

RELATED APPLICATIONS

N/A

BACKGROUND OF THE INVENTION

1. Field of the Invention

The present invention relates generally to urns used for burying or preserving the remains of humans and animals and, more specifically, to a crematory urn for disposing of the cremated remains of a deceased person or animal in a dignified manner leaving a new grown plant or a preexisting plant as a living monument to said person or animal wherein said urn allows scattered seeds or preexisting plants to be put through a perforation.

2. Discussion of the Background

Commonly when a human or an animal die there is a desire for dignified handling of the deceased, a desire for permanence in the disposition of the resulting remains; and, oftentimes, a preference for a specific location for the final resting place of the remains. Several ways to perform these desires had been adopted depending on the culture, economical and/or environmental needs. Cremation, as an alternative to burial or entombment of a deceased person or animal of both human and animal remains, has a long history of usage in many cultures, and is recently becoming the process of choice for an increasingly large number of societies. For example, cremation involves fewer ecological and land use problems, is less expensive than the more established burial practices and can be more easily stored at a repository located in a home or church and if necessary can be easily transferred to another repository After a human or animal is cremated the remains or ashes are placed in the urn and then is either permanently stored in said urn and buried or stored within mausoleums or elsewhere. Sometimes the urn is taken out to sea and thrown overboard or opened and the ashes sprinkled upon the sea.

When the cremation urns are stored comprises a decorative, usually with aesthetically pleasing appearance, body containing a chamber for housing the cremated remains of the deceased. Several attributes and characteristics are typically desired from burial urns. The first desirable attribute is the presence of an outer surface which provides an, thereby making the burial urn suitable for the religious ceremonies that frequently accompany the passing of the deceased. Second, the burial urn preferably is constructed in such a manner so as to effectively protect the urn's contents from external forces that are often imparted thereon. For example, the burial urn generally must be capable of withstanding deterioration and erosion that can be caused by moisture. In addition, generally it is desirable that the burial urn be impervious to rupture in case the urn is accidentally struck.

Several types of cremation urns are available, for example U.S. Pat. No. 5,774,958 Casimir discloses an urn that dissolves when submersed in water, U.S. Pat. No. 5,636,418 Vail discloses an environmentally degradable urn for burial of human cremation ashes in cemeteries and U.S. Pat. No. 4,199,848 to Kohnert discloses a burial urn for displaying a memorial in shape of a book. Other cremation urns, such as U.S. Pat. No. 5,701,642 to Order discloses ecological burial method and apparatus where a tree is planted above a biodegradable coffin structure so that when the coffin structure biodegrades the nutrient or fertilizer, or combinations thereof, are capable of being supplied to the tree to create an ecologically sound environment. Also the more recent patent U.S. Pat. No. 6,516,501 to the present inventor Vazquez-Perez discloses an urn which interacts with its surrounding by dissolving into it, and eventually producing a living monument, in the form of the three. However, none of these devices or methods in the prior art provides a crematory urn, with an associated burial method, which provides a dignified manner of disposing of the remains while the cremation option leaves a living monument from a germinated seed or a existing plant. Thus, there is a need for a cremation urn and burial method which overcomes these and other deficiencies in the prior art.

SUMMARY OF THE INVENTION

The object of the present invention is to provide a dignified manner of disposing of the cremated remains of the deceased wherein a direct contact with the earth is provided for a faster germination of the living monument.

It is another object of the present invention to provide a more compact crematory urn that provides a less expensive, compact and aesthetically pleasing urn.

It is a further object of the present invention to provide a crematory urn constructed to facilitate an easy fragmentation under compression thus enabling a tree or plant to grow from within.

It is another object of the present invention to provide a burial urn made from materials which are preferably all environmentally safe so that they will not pollute the environment.

It is another object of the present invention to provide a crematory urn wherein the living monument can be identified later.

The urn itself, both as to its construction and its mode of operation will be best understood, and additional objects and advantages thereof will become apparent, by the following detailed description of a preferred embodiment taken in conjunction with the accompanying drawings.

When the word "invention" is used in this specification, the word "invention" includes "inventions", that is, the plural of "invention". By stating "invention", the Applicant does not in any way admit that the present application does not include more than one patentably and non-obviously distinct invention, and Applicant maintains that the present application may include more than one patentably and non-obviously distinct invention. The Applicant hereby asserts, that the disclosure of the present application may include more than one invention, and, in the event that there is more than one invention, that these inventions may be patentable and non-obvious one with respect to the other.

BRIEF DESCRIPTION OF THE DRAWINGS

The accompanying drawings which are incorporated herein constitute part of the specification and illustrate embodiments of the invention.

FIG. 3 is a sectional view of the complete urn placed at the particular terrestrial location with ashes and planted with seeds;

FIGS. 4*a*-4*b* is a sectional view of top cover

DESCRIPTION OF THE PREFERRED EMBODIMENT

The urn 1 as constructed in accordance with the present invention comprises a bottom shell 3 having an area for holding cremated remains with a hollow protrusion 3*b* and a top cover 2 resting on the bottom shell 2.

Figure 1:
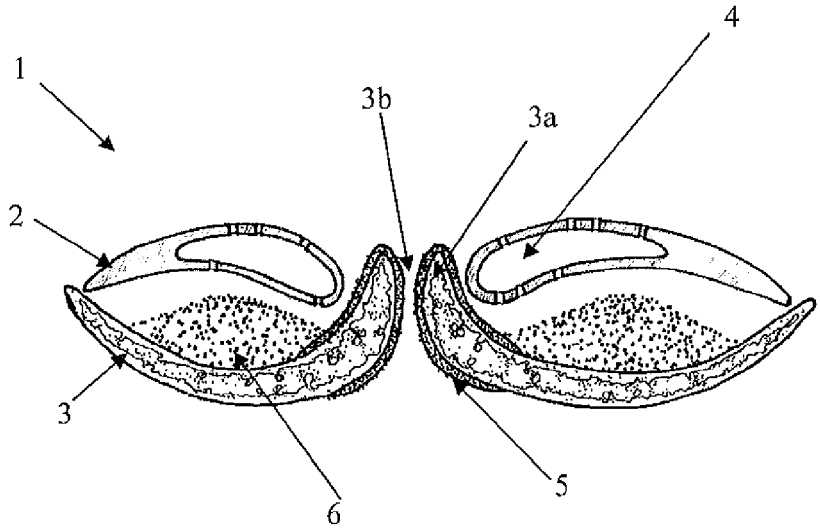
FIG. 1 is a sectional view of the complete urn of the invention, containing human remains.
Figure 2:
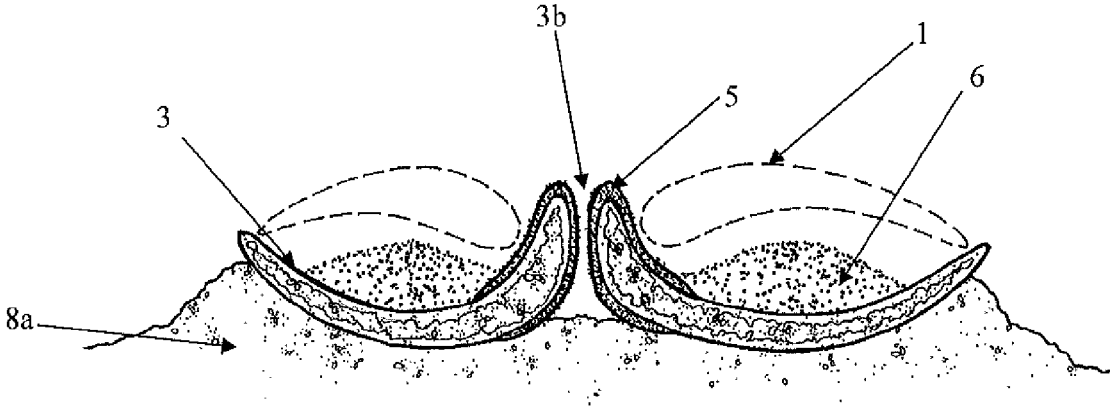
FIG. 2 is a sectional view of bottom shell, with ashes, and removed top cover.

The bottom shell 3 may have several shapes as long is capable of holding the cremated remains. For example, as show in FIG. 1, our first embodiment has of oval shape, with a concave area for holding the cremated remains 6, wherein said bottom shell is made of matrix composition of bio-degradable materials such as but not limit to dirt, clay, recycled carton-paper or a combination thereof, which is cast into its particular form. The matrix composition can be complemented with various fertilizers, nutrients, or a combination thereof, as show in FIGS. 1-3, by adding adding them into the mixture before being cast into form or separately applied to an specific region, more specifically in the area that a faster growth of the plant 7 is wanted. The fertilizer 5 may be located in the first embodiment is located at the hollow protrusion 3*b* which is the portion closer to the plant 7. The bottom shell 3 matrix is ideal because it can be formed into a rigid shell, capable of holding its shape and contents until it is exposed to water or the elements in the environment. For example a concave shell of approximately 16" by 13" and 6" in depth is designed to hold the approximate 2 liters of ashes resulting from a regular cremation of a human body. A hollow protrusion which can be located at the center of the bottom shell, as show in FIGS. 1-3, is designed to hold plant seeds providing a direct contact with the soil under the urn. The use of a hollow protrusion not just serves to place a plant as a seed but also a tree with a stem size smaller than the hollow protrusion. This being convenient for cases where a patient is diagnoses with a fatal disease and said patient start growing a plant. Therefore making the combination of the crematory urn and the pre-existing tree a more significant the event.

The body of this protrusion is aligned in such way that also serves to secure the ceramic top cover 2 in place. The ceramic top cover 2, as show in FIGS. 4*a*-4*b*, comprises several holes 2*a*, free space area 4, an identification device 2*c* and is made of bio-degradable material such as white argillaceous porcelain clay, cast through regular slip-casting methods using plaster molds. Usually said holes 2*a* are provided around the free space 4 area, wherein said free space area 4 is a space created inside top cover 2 structure providing a path for the flow of water in order to promote the direct contact of the water with the soil 8*a* around the plant 7. The holes 2*a* might be arranged in such way to facilitate an easy fragmentation under compression but at the same time providing protection to the remains 6. The piece can also be baked (burned) to a point of medium hardness, to facilitate even more the fragmentation under compression. The slip-casting process is performed evenly to ensure a thin sectional thickness throughout the wall of the form, but especially through the central cavity where the plant will grow, to ensure an easier fragmentation as the tree sprouts (for example approximately 3-16" to ⅜"). The top cover 2 is designed to align its cavity 2*d* with the hollow protrusion 3*a*, in such way that the cavity 2*d* surround said hollow protrusion 3*a*, as shown in FIG. 3, and rest on top of the bottom shell 3. Once in place, the urn resembles a oval shaped urn with at least a hole in the center. It has to be understood that the top cover and the bottom shell might be made of the same biodegradable material or of different material. For example, the top cover 2 might be made of a different stronger material for a better protection of the remains 6 since it is more exposed to the environment than the bottom shell 3.

The identification device 2*c*, as shown in FIG. 4*b*, is integrated to the top cover 2 and is used to find the living monument or plant 7 at a resting environment with several plants. The identification device comprises an automatic identification method such as bar codes, Radio Frequency Identification RFID, biometrics and magnetic stripes.

Figure 5:
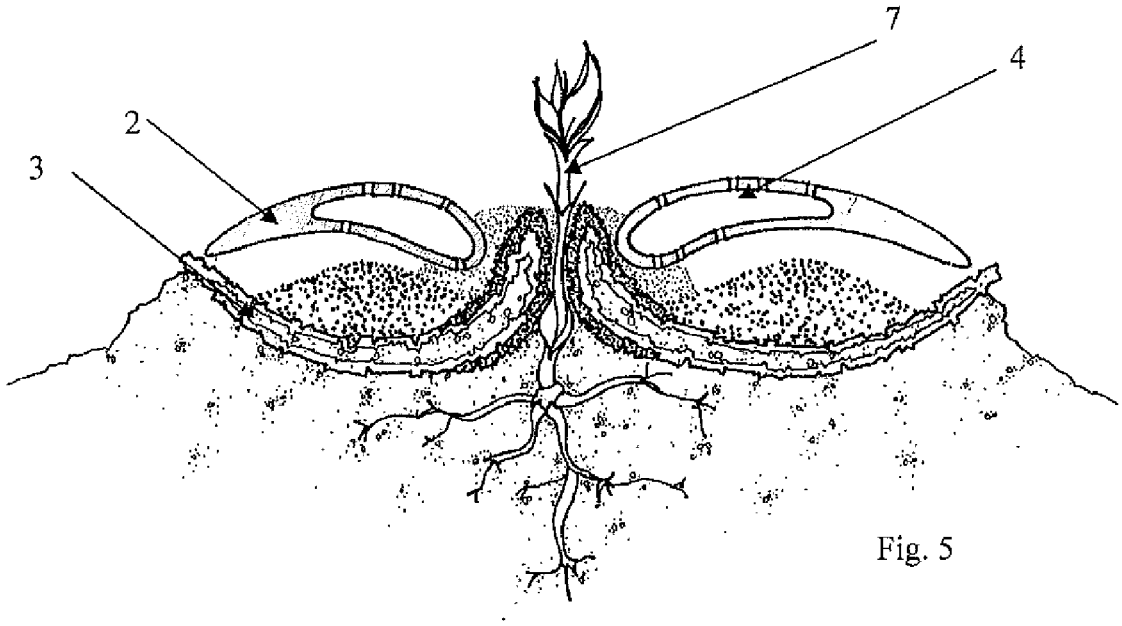
FIG. 5 is a sectional view of earthbound urn, with growing plant.
Figure 6:
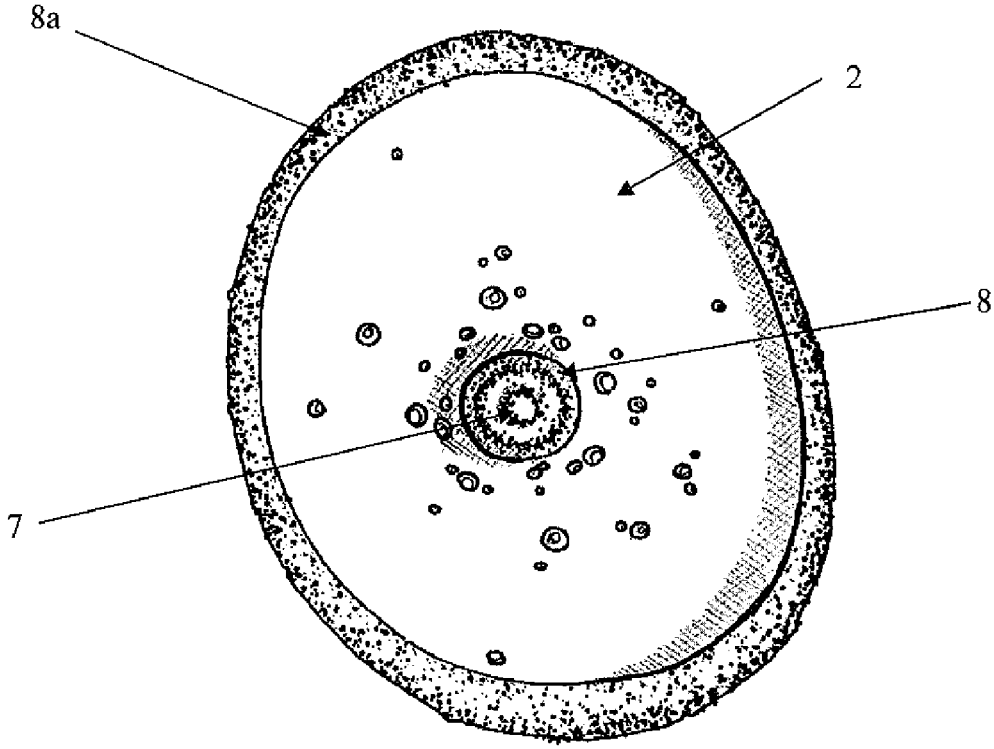
FIG. 6 is a top view of the urn in their resting environment, with a growing plant.
Figure 7:
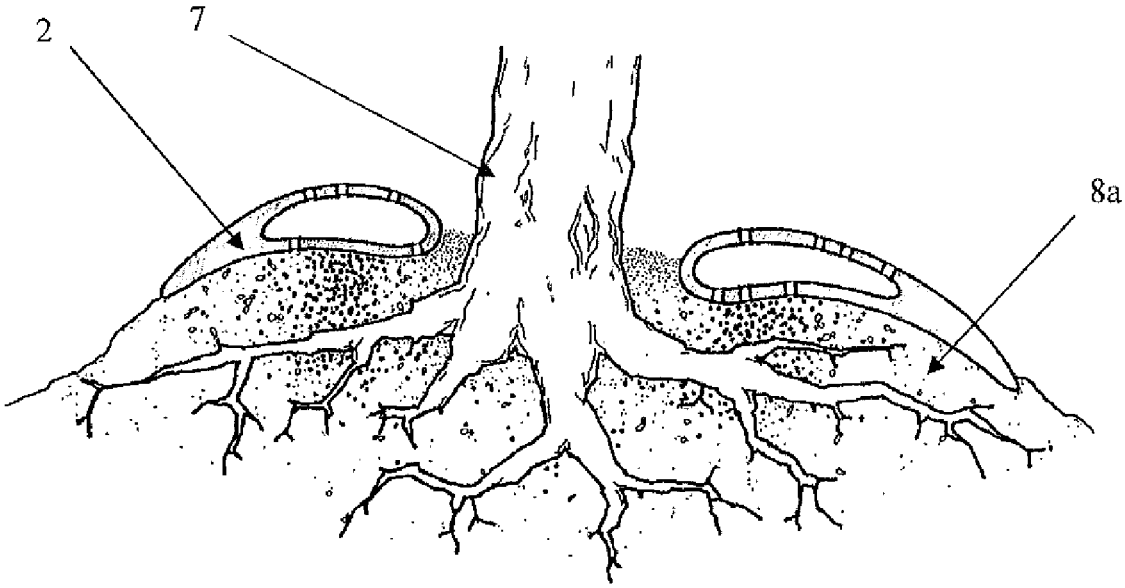
FIG. 7 is a sectional view of broken/disintegrated bottom shell, with grown tree trunk.
Figure 8:
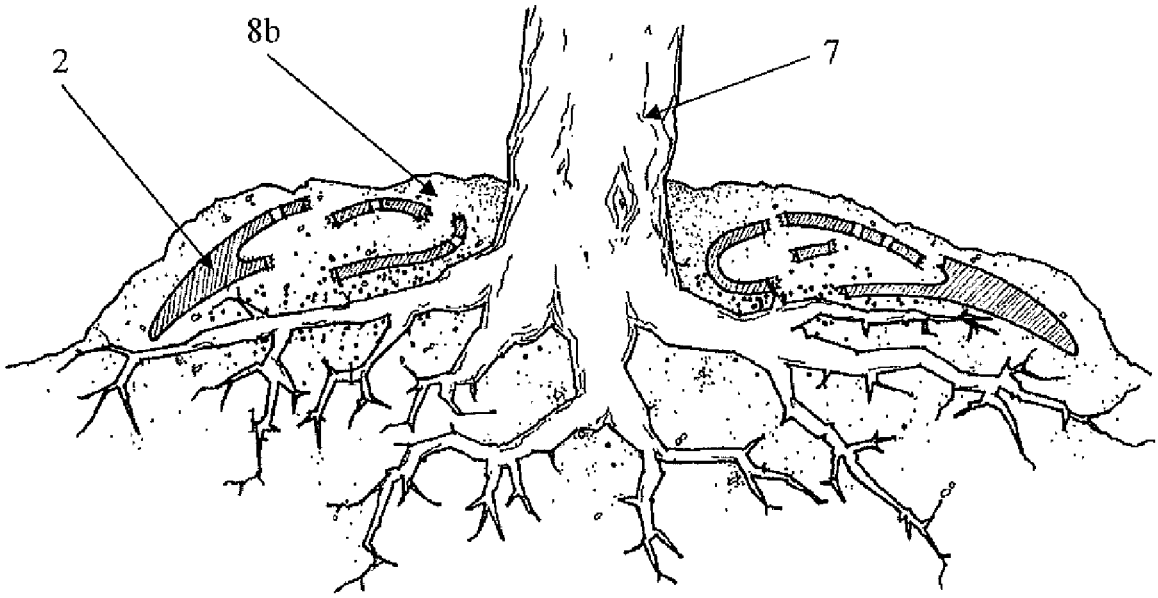
FIG. 8 is a sectional view of broken/disintegrated top cover, with grown tree trunk.
Figure 9:
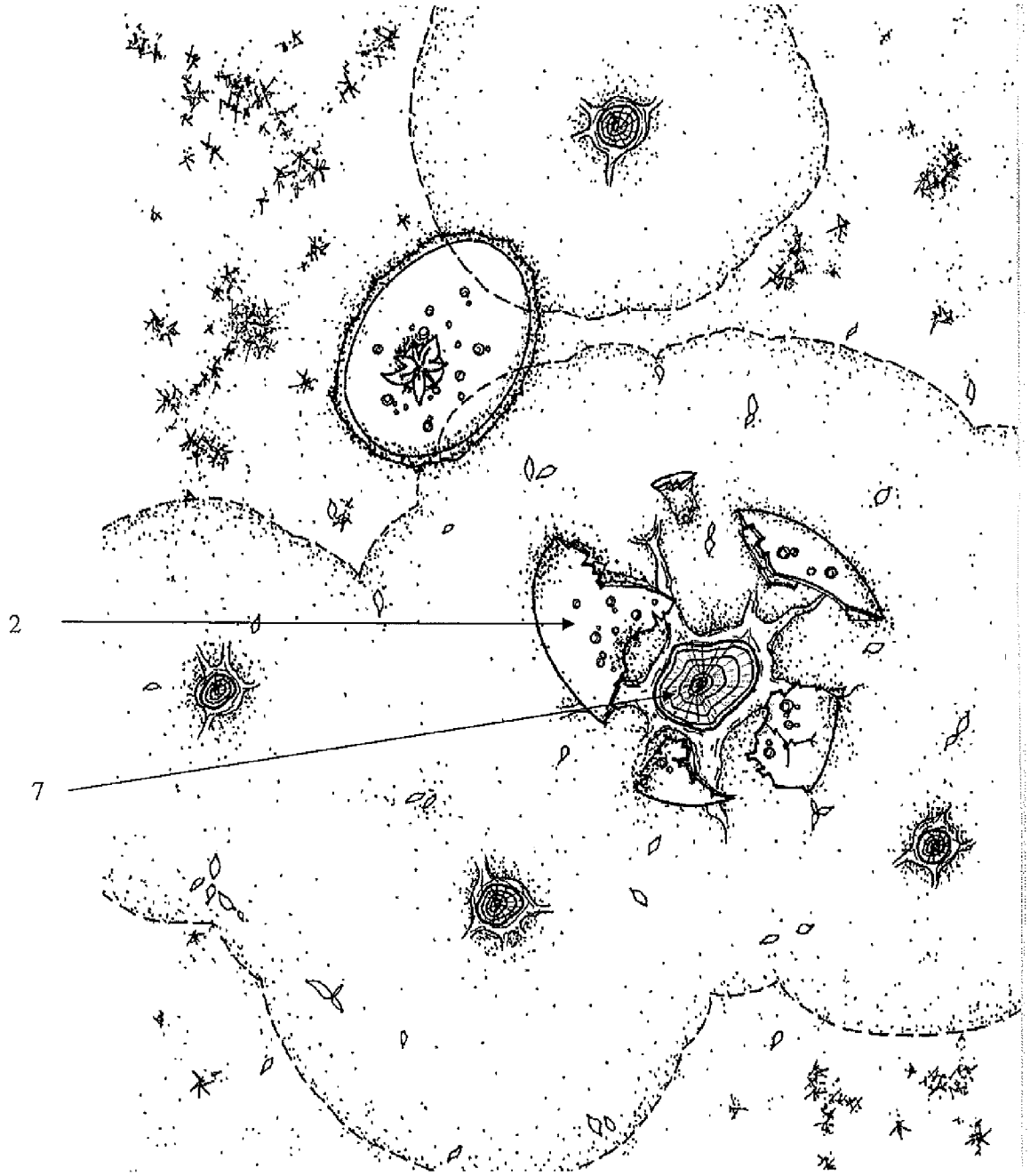
FIG. 9 is a top view of the urns in their resting environment, with a growing plants.

The urns of the invention are designed to be laid outdoors, on fertile-ground areas that promote the natural growth of plants and trees. FIGS. 5-9 show the growth of the plants using the present invention. FIG. 5 and FIG. 6 illustrate the process of the young tree growing while the bottom shell is becoming one with the soil 8*a* under the urn. Eventually the bottom shell is disintegrated while the plant keeps growing to the extent of breaking the top cover 2 by applying pressure as shown in FIGS. 7 to 9.

Several methods for the operation of the present invention might be used. One of said methods is describe below, wherein said method allow the cemeteries to be used for the preservation of flora, fauna, and of ecological systems. In the operation of the funeral rite, the user emulates a process similar to the following:

1. A preferred spot is selected in the desired place of entombment. Once found, a small amount of soil is removed from the earth surface, if necessary, so as to have a natural base on the terrain to accommodate the urn.

2. The urn is placed in the lightly excavated area. It is then opened up itself, by removing the top cover 2, having only the bottom shell 3 facing up. It is then that the cremated remains 6 of the deceased are to be placed in it, spread around the hollow protrusion 3*a*.

3. At this point, the bottom shell 3 is covered again with the top cover 2, perfectly enclosing the cremated remains 6 inside, only revealing the top part of the hollow protrusion 3*a*.

4. Then a plant 7 is placed, in the form of seed or tree with a stem size smaller than the hollow protrusion at said hollow protrusion 3*a* and then slightly covering them with part of the excess earth 8*b* that was previously dug out.

5. Allowing said bottom shell to be exposed to its new environment, absorbs and retains surrounding moisture, promoting the germination 14 of the contained seeds 7. The eventual growth of the gestating tree breaks through the top cover cavity 2*d*, and as its caliper thickens, the ceramic top cover crushes akin to an egg's shell fracturing to reveal its hatching.

The crematory urns are conceived to be used in a ceremony that promotes an affirmation of natural continuity and of the earth with a living monument germinated before or after the patient's dead.

The crematory urns of the invention were conceived with no particular plant 7 in mind. Nevertheless, the selection of plant 7 shall be determined by but not limit to a series of factors:

1. Location—Only native species to the particular area of planting should be used.

2. Timing—Planting season should be adequate for selected species, unless planting is to be initiated within a controlled environment (i.e. greenhouse)

3. Preparation—plants 7 need to be pre-processed, pre-treated, and ready for planting according to its species and environment, in order to encourage a successful germination.

4. Size—Single plant bulbs, or the combination of a few bulbs with soil, have to fit approximately within hollow protrusion radio area.

5. Preference—When all other considerations allow it, tree species selection can conform to the personal preference of the user.

Thus, there has been shown and described a method and apparatus for ecological burial which fulfills all the objects and advantages sought therefor. The invention is not limited to the precise configuration described above. While the invention has been described as having a preferred design, it is understood that many changes, modifications, variations and other uses and applications of the subject invention will, however, become apparent to those skilled in the art without materially departing from the novel teaching and advantages of this invention after considering this specification together with the accompanying drawings. For example, the particular shapes and proportions of the elements of the urn may be varied as desired. Accordingly, all such changes, modifications, variations and other uses and applications which do not depart from the spirit and scope of the invention are deemed to be covered by this invention as defined in the following claims.

All of the patents recited herein, and in the Declaration attached hereto, are hereby incorporated by reference as if set forth in their entirety herein. The details in such patents may be considered to be incorporable at applicant's option, into the claims during prosecution as further limitations in the claims to patentably distinguish any amended claims from any applied prior art.

What is claimed is:

1. A crematory urn for the disposal of cremated remains comprising:

a bottom shell, wherein said bottom shell comprises an area for holding the cremated remains and a hollow protrusion; and a top cover, wherein said top cover is designed to rest on top of said bottom shell, said top cover having several holes around a free space defined within said top cover, said top cover further defining a cavity, wherein said cavity is aligned with the bottom shell hollow protrusion.

2. The crematory urn of claim 1, wherein said bottom shell is made from biodegradable materials.

3. The crematory urn of claim 2, wherein said biodegradable material comprises: dirt, clay, recycled carton-paper or a combination thereof.

4. The crematory urn of claim 2, wherein said biodegradable material further comprises a plurality of fertilizers and nutrients.

5. The crematory urn of claim 1, wherein said top cover is made of biodegradable material.

6. The crematory urn of claim 1, wherein said top cover and said bottom shell are made of the same material.

7. The crematory urn of claim 1, wherein said top cover and said bottom shell are made of different material.

8. The crematory urn of claim 1, wherein said bottom shell area for holding the remains comprises a concave shape surrounding the hollow protrusion.

9. The crematory urn of claim 1, wherein said top cover holes are arranged as to facilitate an easy fragmentation under compression.

10. The crematory urn of claim 1, wherein said crematory urn comprises an identification device.

11. The crematory urn of claim 10, wherein said identification device is located at the top cover.

12. The crematory urn of claim 10, wherein said identification device comprises an automatic identification device.

13. The crematory urn of claim 12, wherein said automatic identification device comprises bar codes, Radio Frequency Identification RFID, biometrics or magnetic stripes.

14. A method of using said crematory urn as defined in claim 1 for the dignified entombment of the cremated remains comprising the steps of:

(a) choosing a particular terrestrial location for said dignified entombment;

(b) removing a small amount of soil from the earth surface at said particular terrestrial location so as to have a dug area providing a natural base on the terrain to accommodate said crematory urn in the dug area;

(c) placing the crematory urn in said dug area;

(d) opening said crematory urn by removing said top cover, having said bottom shell hollow protrusion extending away from the earth;

(e) placing said cremated remains is said bottom shell, said cremated remains being spread around said bottom shell's hollow protrusion;

(f) covering said bottom shell with said top cover, said cremated remains being enclosed inside, and said hollow protrusion aligned with said top cover cavity;

(g) placing a plant at said hollow protrusion, said plant in the form of seed or tree with a stem size smaller than the hollow protrusion;

(h) covering said plant at the hollow protrusion with part of the excess soil that was previously dug out;

(i) allowing said bottom shell to absorb and retain surrounding moisture so as to promote the germination of said seeds so that the eventual growth of the gestating tree breaks through said cavity on said top cover, said top cover being crushed as the tree's caliper thickens.

* * * * *